US008186645B2

(12) United States Patent
Shaw et al.

(10) Patent No.: US 8,186,645 B2
(45) Date of Patent: May 29, 2012

(54) TILT-UP CONCRETE FORM BRACE

(75) Inventors: Scott Shaw, Redlands, CA (US); Dale Robert Haslem, Claremont, CA (US); Ken Lee, Anaheim, CA (US); Steve Wilbur, Chino, CA (US); Clifford D. Bennett, Alta Loma, CA (US)

(73) Assignee: Dayton Superior Corporation, Dayton, OH (US)

( * ) Notice: Subject to any disclaimer, the term of this patent is extended or adjusted under 35 U.S.C. 154(b) by 731 days.

(21) Appl. No.: 10/121,125

(22) Filed: Apr. 11, 2002

(65) Prior Publication Data

US 2002/0145093 A1 Oct. 10, 2002

Related U.S. Application Data

(63) Continuation-in-part of application No. 09/725,524, filed on Nov. 29, 2000, now abandoned.

(51) Int. Cl.
*E04G 17/00* (2006.01)

(52) U.S. Cl. ..... 249/219.1; 248/205.3

(58) Field of Classification Search ..... 249/219.1, 249/2–8; 248/351, 205.4, 205.3; 47/33; 404/7; 52/102
See application file for complete search history.

(56) References Cited

U.S. PATENT DOCUMENTS

| | | | | | |
|---|---|---|---|---|---|
| 1,374,894 | A | | 4/1921 | Ambursen | 52/712 |
| 1,512,165 | A | * | 10/1924 | Funkhouser | 249/6 |
| 1,527,698 | A | * | 2/1925 | Pearthree | 249/7 |
| 1,722,144 | A | * | 7/1929 | Heltzel | 249/6 |
| 1,944,511 | A | * | 1/1934 | Heltzel | 249/6 |
| 2,063,748 | A | * | 12/1936 | Olsen | 52/745.1 |
| 2,994,905 | A | * | 8/1961 | Franker, Jr. | 52/273 |
| 3,202,393 | A | | 8/1965 | Pettit | 249/2 |
| 3,400,847 | A | | 9/1968 | Stute | 217/69 |
| 3,582,035 | A | | 6/1971 | Wells et al. | 249/18 |

(Continued)

FOREIGN PATENT DOCUMENTS

DE 3503810 8/1986

(Continued)

OTHER PUBLICATIONS

Maltry Theodor H (DE), *English Abstract of Shuttering Element for Reinforced-Concrete Structures*, Patent No. DE3129838, esp@cenet database, Feb. 1983 (1 page).

(Continued)

*Primary Examiner* — Korie Chan
(74) *Attorney, Agent, or Firm* — Thompson Hine LLP

(57) ABSTRACT

A brace for use in tilt-up construction is disclosed. The brace includes a bottom surface and a vertical side surface. The bottom surface of the brace is affixed to a permanent horizontal surface (e.g., a slab) in a manner that allows the brace to be removed without damaging the permanent horizontal surface. The vertical side surface of the brace is attached to a concrete pour form. The bottom surface of the brace is affixed to the permanent horizontal surface using an adhesive. Alternatively, a shoe is attached to the permanent horizontal surface and the brace sits in the shoe. A flange is releasably securable with the brace to batter the form when the flange is place in contact therewith. Alternatively, the shoe has an upwardly extending inclined ramp that is operable to orient the brace so that the vertical side surface of the brace is disposed at a battering angle to batter the form.

12 Claims, 6 Drawing Sheets

U.S. PATENT DOCUMENTS

| | | | | | |
|---|---|---|---|---|---|
| 3,584,826 | A | | 6/1971 | Liester | 249/35 |
| 3,609,935 | A | | 10/1971 | Thomas | 52/745 |
| RE27,258 | E | * | 12/1971 | Yunker et al. | 114/287 |
| 3,632,078 | A | | 1/1972 | Dashew | 249/183 |
| 3,637,181 | A | | 1/1972 | Janssen | 248/205 |
| 3,681,882 | A | | 8/1972 | Bettinger | 52/126 |
| 3,700,202 | A | | 10/1972 | Donnels | 248/354 |
| 3,743,286 | A | * | 7/1973 | Weinhagen et al. | 473/481 |
| 3,775,240 | A | | 11/1973 | Harvey | 161/149 |
| 3,797,800 | A | * | 3/1974 | Loy | 249/13 |
| 3,817,006 | A | * | 6/1974 | Williams | 52/127.2 |
| 3,979,093 | A | | 9/1976 | Madden | 248/56 |
| 4,042,205 | A | | 8/1977 | Herrell | 249/189 |
| 4,083,156 | A | | 4/1978 | Tye | 52/127 |
| 4,101,111 | A | * | 7/1978 | Bishop | 249/205 |
| 4,104,356 | A | | 8/1978 | Deutsch et al. | 264/297 |
| 4,123,882 | A | | 11/1978 | Case et al. | 52/125 |
| 4,124,907 | A | * | 11/1978 | Laven | 52/169.7 |
| 4,339,106 | A | | 7/1982 | Navarro | 249/219 |
| 4,389,831 | A | | 6/1983 | Baumann | 52/741 |
| 4,393,568 | A | | 7/1983 | Navarro | 29/432 |
| 4,542,613 | A | | 9/1985 | Leyte-Vidal | 52/375 |
| 4,553,751 | A | * | 11/1985 | Ketchum | 473/435 |
| 4,576,664 | A | | 3/1986 | Delahunty | 156/71 |
| 4,659,057 | A | | 4/1987 | Felter | 249/97 |
| 4,695,211 | A | * | 9/1987 | Van Iperen et al. | 410/77 |
| 4,724,968 | A | * | 2/1988 | Wombacher | 211/59.3 |
| 4,841,702 | A | | 6/1989 | Huettemann | 52/309.12 |
| 4,846,437 | A | * | 7/1989 | Fitzgerald | 249/3 |
| 5,076,079 | A | * | 12/1991 | Monoson et al. | 70/58 |
| 5,096,155 | A | | 3/1992 | Fitzgerald | 249/219.1 |
| 5,205,942 | A | * | 4/1993 | Fitzgerald | 249/3 |
| 5,212,920 | A | | 5/1993 | Tye | 52/127.1 |
| 5,226,265 | A | | 7/1993 | Kelly et al. | 52/125.6 |
| 5,377,447 | A | * | 1/1995 | Fritch | 47/33 |
| 5,489,468 | A | | 2/1996 | Davidson | 428/261 |
| 5,491,948 | A | | 2/1996 | Harris | 52/596 |
| 5,656,194 | A | * | 8/1997 | Zimmerman | 249/160 |
| 5,662,305 | A | * | 9/1997 | Shimamura et al. | 248/500 |
| 5,664,749 | A | * | 9/1997 | Kump et al. | 248/220.22 |
| 5,692,722 | A | * | 12/1997 | Lundagårds | 248/553 |
| 5,695,165 | A | * | 12/1997 | Moriarty | 248/316.8 |
| 5,817,247 | A | | 10/1998 | Colatruglio | 249/4 |
| 5,843,327 | A | * | 12/1998 | Lindgren | 249/210 |
| 6,067,757 | A | | 5/2000 | Olson et al. | 52/125.1 |
| 6,073,405 | A | * | 6/2000 | Kasai et al. | 52/283 |
| 6,182,416 | B1 | | 2/2001 | Brackin | 52/745.09 |
| 6,230,451 | B1 | | 5/2001 | Stoller | 52/169.1 |
| 6,412,745 | B1 | * | 7/2002 | Yokoyama et al. | 248/500 |
| 6,540,201 | B1 | * | 4/2003 | Gagnon et al. | 249/139 |

FOREIGN PATENT DOCUMENTS

| | | | |
|---|---|---|---|
| JP | 6-129043 | | 5/1994 |
| JP | 10246212 | A * | 9/1998 |
| WO | WO 02/43534 | | 6/2002 |

OTHER PUBLICATIONS

Berreth Rainer Dipl Ing (DE), *English Abstract of Angular Shuttering Element for Floors*, Patent No. DE3430564, esp@cenet database, Mar. 1986 (1 page).

Reymann Wolfgang (DE), *English Abstract of Shuttering-System for Concrete Elements*, Patent No. EP0639686, esp@cenet database, Feb. 1995 (1 page).

ISA/US, *International Search Report*, Feb. 2002 (4 pages).

White Cap Industries, *Panel-Trak Forming System*, www.whitecapdirect.com, Nov. 14, 2001 (4 pages).

* cited by examiner

TILT-UP CONCRETE FORM BRACE

CROSS-REFERENCE

The present application is a continuation-in-part of U.S. Ser. No. 09/725,524, filed Nov. 29, 2000 now abandoned, the disclosure of which is hereby incorporated herein by reference in its entirety.

BACKGROUND OF THE INVENTION

The present invention is directed generally toward a brace or bracket which is utilized in the formation of walls for tilt-up concrete building structures and more particularly to a preformed, molded brace, preferably plastic, which is utilized to support a concrete wall form at a desired position upon a previously poured concrete slab floor.

Many industrial/commercial structures are formed using a tilt-up concrete wall construction technique. As shown in FIG. 1, in this type of construction technique, a concrete slab flooring 10 is poured on a site and allowed to cure. Subsequently, the slab floor 10 is used as a platform to enable the side walls 12 to be poured in a horizontal orientation on top of the concrete slab flooring 10. After curing, the side walls are tilted upward in a perpendicular orientation to the slab floor and affixed together to form the vertical side walls of the structure. In forming the side walls, it is conventional that concrete forms 14 such as 2×4's and/or 2×6's and/or 2×8's are positioned on the top of the previously formed concrete slab 10 to define a perimeter area wherein a concrete pour is made within the form and on top of the concrete slab. In setting up the form work 14 upon the slab 10, it is conventional to utilize a metal or wood L-shaped bracket 16, the lower surface of which is directly abutted into the concrete slab 10 and the vertical surface of which may be used to be attached to the form work 14 and hold the form work in a generally perpendicular orientation to the slab.

U.S. Pat. No. 3,609,935 issued to D. L. Thomas Oct. 5, 1971 discloses a permanent form 14 for pre-cast tilt-up concrete modules. The brackets 16 or corner pieces include plural nail openings through which nails are driven into the slab 10. U.S. Pat. No. 4,123,882 issued to Case et al. on Nov. 7, 1978 discloses a method and apparatus for erecting a concrete wall panel which utilizes a pre-cast insert in the wall panel to enable rapid panel pick up. U.S. Pat. No. 5,212,920 issued to Tye on May 25, 1993 discloses a strong back attachment system for concrete panel tilt-up construction.

U.S. Pat. No. 4,042,205 issued to Herrell on Aug. 16, 1977 discloses a reusable mold element for horizontally forming panels. The particular forming members are maintained in the slab 10 via plural nails. U.S. Pat. No. 4,083,156 issued to Tye on Apr. 11, 1978 discloses an apparatus for bracing a tilt-up wall panel wherein universal panel braces are utilized. The panel braces are affixed to the slab via permanent anchors. U.S. Pat. No. 3,700,202 issued to Donnels on Oct. 24, 1972 discloses an adjustable brace similar to the one disclosed in U.S. Pat. No. 4,083,156 (Tye).

U.S. Pat. No. 5,491,948 issued to Harris on Feb. 20, 1996 discloses a tilt-up concrete pad and method of forming and erecting the tilt-up concrete pad which utilizes reusable forms. The brackets 16 utilized in the system appear to be permanently attached via nails to the flooring. U.S. Pat. No. 5,226,265 issued to Kelly et al. on Jul. 13, 1993 discloses a unique apparatus and method for lifting tilt-up wall constructions which is inserted into the concrete pour. U.S. Pat. No. 4,389,831 issued to Baumann on Jan. 28, 1983 discloses a simplified construction system for pre-cast concrete walls wherein the floor, ceiling and side walls are formed upon the slab 10 and subsequently pivoted upward into a final orientation. U.S. Pat. No. 4,339,106 issued to Navarro on Jul. 13, 1982 discloses a reusable bracket assembly for concrete form which includes brackets 16 that are maintained upon the slab via plural nails. U.S. Pat. No. 6,067,757 issued to Olsen et al. on May 30, 2000 discloses a tilt-up concrete panel and forming system which utilizes a bracket 16 which includes plural apertures for receiving nails therethrough. U.S. Pat. No. 4,104,356 issued to Deutsch et al. on Aug. 1, 1978 discloses a tilt-up panel bracket 16 formed of metal and adapted for power driven fasteners into the slab 10.

As shown in FIG. 2, the prior art metal or wood brace 16 typically utilizes nails 20 which are driven into the concrete slab flooring 10. In this regard, a contractor typically first drills one or more holes into the slab since a nail 20 cannot typically be driven directly into the slab 10 without breaking or cracking the slab. Thereafter, a nail 20 is inserted into each hole, pounded into the slab 10 and the wooden concrete form 14 is then attached to the opposite side of the bracket 16 to enable a subsequent pouring of the side walls within the interior of the frameworks. After curing of the pour, the brace or bracket 16 is removed from the slab 10 and the forms 14 removed therefrom. In removing the prior art bracket 16 and nails 20 from the slab 10, it is typical that the slab 10 breaks open in the area of the nail 22, thereby requiring subsequent patching of the slab 10, which is visually unpleasing and structurally unsound. Even if the slab is not damaged, patching is required to fill in the nail hole. As such, the prior art bracing and attachment of the bracing to the slab 10 via nails 20 is time consuming, structurally deficient and results in patchwork to the slab which is visually unpleasant.

Thus, a need exists for a brace which is utilized in the formation of walls for tilt-up concrete building structures wherein removal of the brace will not cause breaks in the previously poured concrete slab floor.

BRIEF SUMMARY OF THE INVENTION

The present invention overcomes the foregoing and other shortcomings and drawbacks of the tilt-up concrete form brace and methods of erecting concrete pour forms heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the present invention, a brace for use in tilt-up construction is disclosed. The brace is generally triangular in shape and includes a bottom surface and a vertical side surface or form facing surface. The bottom surface of the brace is affixed to a permanent horizontal surface (e.g., a slab) in a manner that allows the brace to be removed without damaging the permanent horizontal surface. The vertical side surface of the brace is attached to a concrete pour form. The concrete pour form can be made of various materials (e.g., wood or metal).

In accordance with other aspects of the invention, the bottom surface of the brace is affixed to the permanent horizontal surface using an adhesive, such as double-sided tape. Preferably, the bottom surface of the brace also includes holes so that the brace can be affixed to the permanent horizontal surface using nails instead of or in addition to the adhesive. The adhesive may be applied to the brace at the time of manufacture.

In accordance with yet other aspects of the invention, the vertical side surface is attached to the form using an adhesive. Preferably, the vertical side surface includes holes so that the vertical side surface can be attached to the form using nails instead of or in addition to the adhesive.

In accordance with still other aspects of the invention, a shoe is attached to the permanent horizontal surface and the brace locks into the shoe. For example, the shoe and the brace are molded in a manner which allows the brace to snap or lock into place. The shoe and the brace may be molded out of a plastic material.

In accordance with additional aspects of the invention, a flange is releasably securable with the brace and has a form engaging surface disposed at a battering angle relative to the vertical side surface of the brace to batter the form when placed in contact herewith. The flange may be connected to the brace with a frangible connecting member which allows the flange to be placed between the brace and the form if desired. Alternatively, the flange may be a separate component that is releasably secured to the brace when battering of the form is required.

In accordance with yet other aspects of the invention, the shoe may include an upwardly extending inclined ramp that is operable to orient the brace so that the vertical side surface of the brace is disposed at a battering angle to batter the form.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

The present invention is a brace or bracket for use in tilt-up construction that does not require the nailing the brace to the slab 10. In exemplary embodiments, such as the one shown in FIG. 3, a generally triangle-shaped pre-formed brace element 30 is attached to the slab 10 via an adhesive which is applied to the lower surface of the brace 30. The brace element is a preformed, molded brace, preferably, plastic. Preferably, the adhesive (e.g., double-sided tape) is applied at the time of manufacturing of the brace 30, and is covered via a slip sheet which when removed, allows the adhesive to grip the slab 10. Preferably, the brace is constructed so as to be disposable. However, it is possible that the brace may not be damaged during the removal process. Thus, preferably, additional adhesive can be added so that the brace can be reused if desired.

Figure 1:
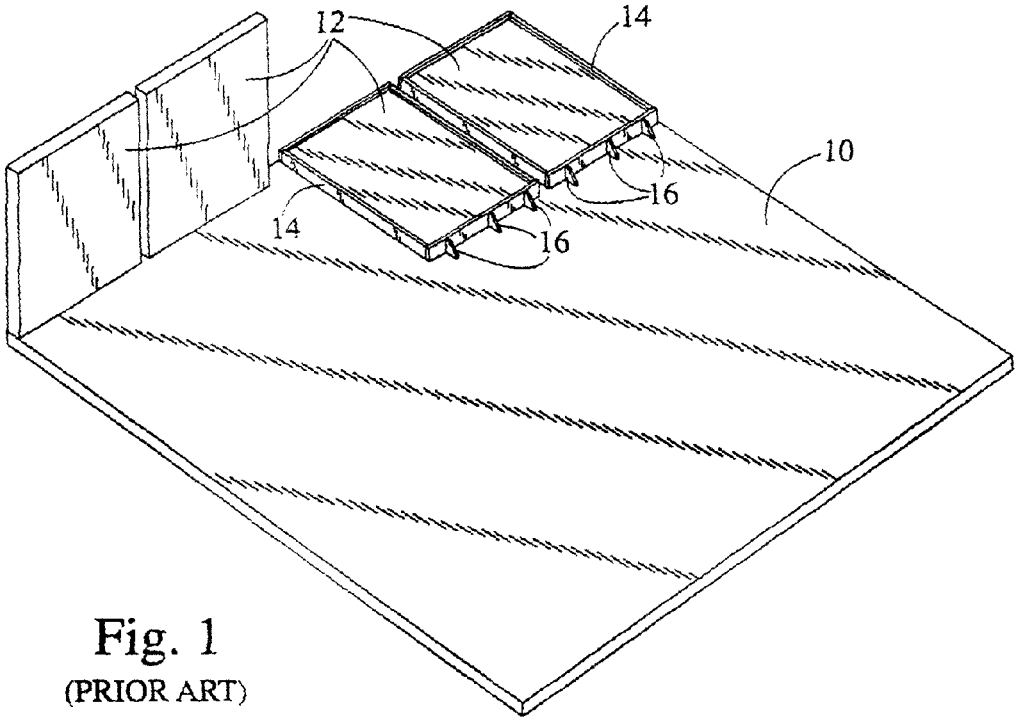
Fig. 1 (PRIOR ART)
FIG. 1 is an illustration showing prior art tilt-up construction wherein concrete pour forms are nailed to a slab using brackets.
Figure 2:
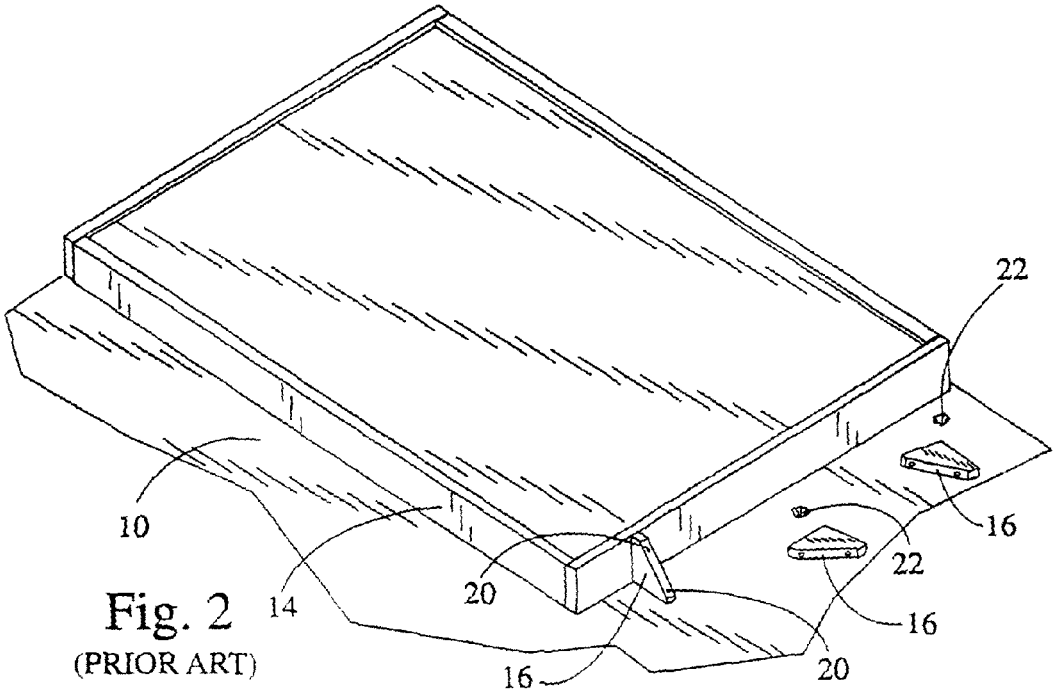
Fig. 2 (PRIOR ART)
FIG. 2 is an illustration of a prior art bracket used in the tilt-up construction shown in FIG. 1.
Figure 3:
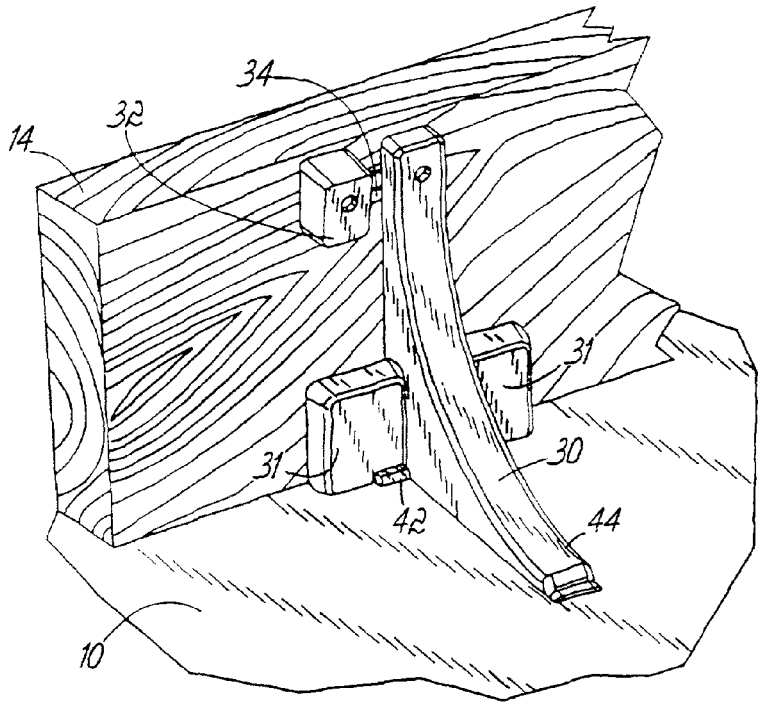
FIG. 3 is an illustration of a brace for use in tilt-up construction formed in accordance with one aspect of the present invention.

The vertical side surface or form facing surface of the brace 30 may be connected to a conventional form 14, to enable the form or formwork 14 to be positioned upon the slab 10 and allow the concrete wall pour to occur. Traditionally, the concrete pour forms are constructed of wood, however, it will be appreciated that pour forms can be constructed of other materials, for example, metal. The brace 30 may be secured to the form 14 using an adhesive. Alternatively, the brace can be secured to the form using traditional means, such as nails. In exemplary embodiments (not shown), the brace 30 has holes in the vertical side surface of the brace so that the brace can be easily attached to the form 14 using nails if desired. In one embodiment, as shown in FIG. 3, the brace 30 has a pair of nail flanges 31 (one on each side of the brace) that may be used to attach the brace 30 to the form 14 using nails. In exemplary embodiments, the brace 30 is molded to include the nail flanges 31 in a one-piece construction. In alternate embodiments, the nail flanges 31 are separate pieces molded to attach (for example, by snapping into place) to a separate brace piece.

Preferably, the adhesive is sufficient to temporarily position the brace 30 upon the slab 10, yet sufficiently weak that when desired the brace 30 can be quickly removed from the slab 10, for example, by hitting the brace 30 with a hammer. As such, the present invention allows for the rapid placement of the brace 30 upon the slab 10 without the drilling of the slab for nails and without requiring the slab to be patched after removal of the brace. In exemplary embodiments, there are holes on the lower surface of the brace 30 so that the brace can be secured to the slab 10 using nails if desired.

Figure 4:
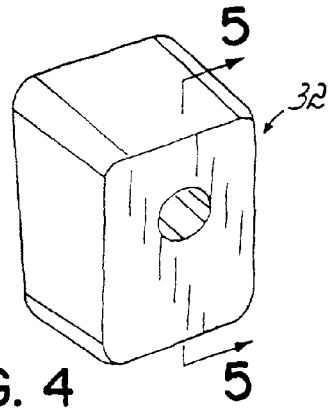
FIG. 4 is a perspective view of a flange that may be included in various embodiments of the brace of FIG. 3.
Figure 5:
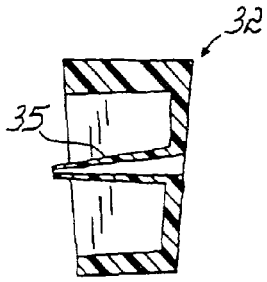
FIG. 5 is a cross section of the flange of FIG. 4.

In exemplary embodiments, the brace 30 includes a flange 32 (shown in FIGS. 3-5) that can be used to batter or angle the form 14 relative to the brace 30. For example, it may be desirable to angle the form so that this side of the wall panel which becomes the top of the wall is angled inward to the building, thus causing rain water to flow to the roof of the building, rather than down the exterior side of the building. The flange 32 is connected to the brace 30 with a frangible connecting member 34 which allows the flange 32 to be positioned between the brace 30 and the form 14 if desired. The flange 32 may have a molded projection 35 (FIG. 5) which is frictionally engagable with a receiving bore (not shown) provided in the brace 30. The projection 35 of the flange 32 and the receiving bore (not shown) of the brace 30 define a pair of aligned apertures which are adapted to receive a fastener, such as a nail, for securing the brace 30 to the form 14.

Figure 6:
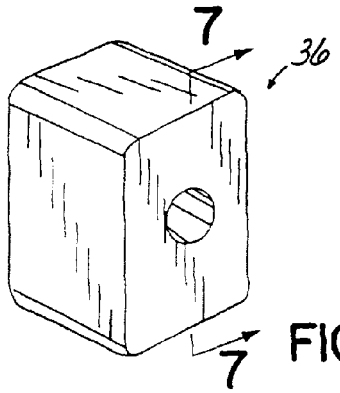
FIG. 6 is a perspective view of a wedge piece that may be included in various embodiments of the brace of FIG. 3.
Figure 7:
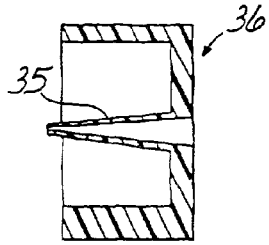
FIG. 7 is a cross section of the wedge piece of FIG. 6.

In alternative exemplary embodiments, the brace 30 includes a wedge piece 36 (such as the one shown in FIGS. 6 and 7) that can be used to take up space between the brace 30 and the form 14. A wedge piece 36 may be desirable if the form is warped. The wedge piece 36 is connected to the brace 30 in a manner similar to the manner in which the flange 32 is connected to the brace. The wedge piece 36 may have a molded projection 37 (FIG. 7) which is frictionally engagable with the receiving bore (not shown) provided in the brace 30. The projection 37 of the wedge piece 36 and the receiving bore (not shown) of the brace 30 define a pair of aligned apertures that are adapted to receive a fastener, such as a nail, for securing the brace 30 to the form 14. It will be appreciated that various embodiments do not include a wedge or a flange. It will also be appreciated that in those embodiments that do include a wedge or a flange, it is not necessary that the wedge or flange be utilized.

Figure 8:
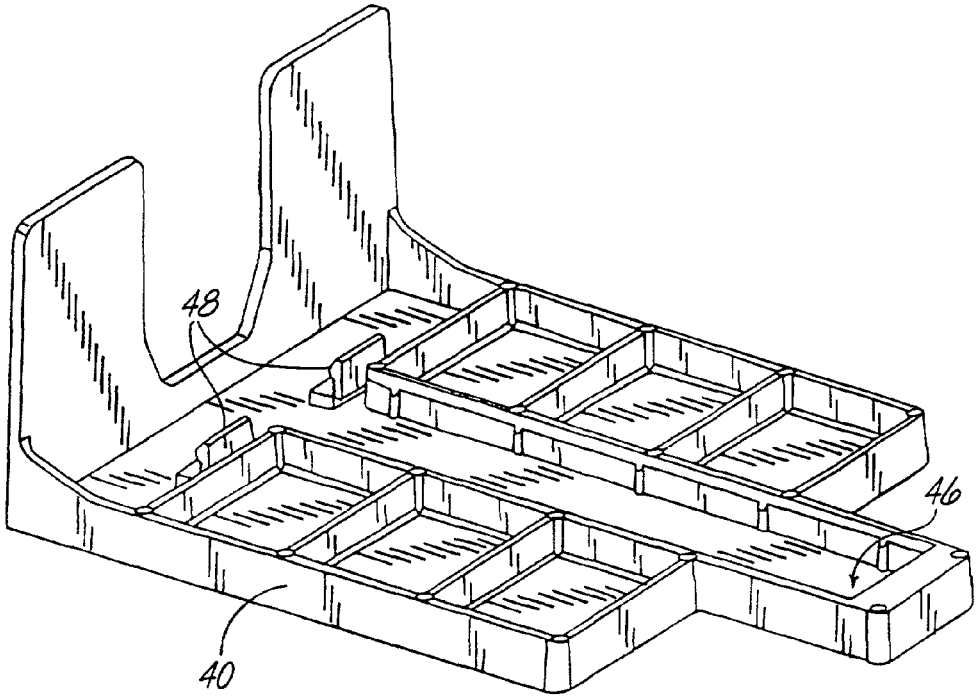
FIG. 8 is an illustration of a shoe which can be used to hold the brace shown in FIG. 3.

Alternative embodiments of the brace are formed with a two-piece construction, i.e., the brace 30 as shown in FIG. 3 and a brace shoe or pad 40 as shown in FIG. 8. In this embodiment, the shoe 40 is provided with the adhesive for attachment to the slab 10 while the brace 30 may be manually inserted and removed from the base or shoe 40. As such, the brace 30 can be reused for multiple applications while the shoe 40 can be made to be disposable. Preferably, the shoe 40 has holes on the lower surface so that the shoe can be nailed to the slab 10 if desired. The shoe 40 and the brace 30 may be molded in a manner which allows the brace to snap or lock into place. In one embodiment, as shown in FIG. 3, the brace 30 has a pair of tabs 42 (one shown) and a tongue 44. In use, the tongue 44 is received in a pocket 46 (FIG. 8) formed in the shoe 40, and the brace 30 is then snapped or locked into the shoe 40 by engaging the tabs 42 of the brace 30 with a pair of resilient latches 48 formed on the shoe 40.

Figure 9:
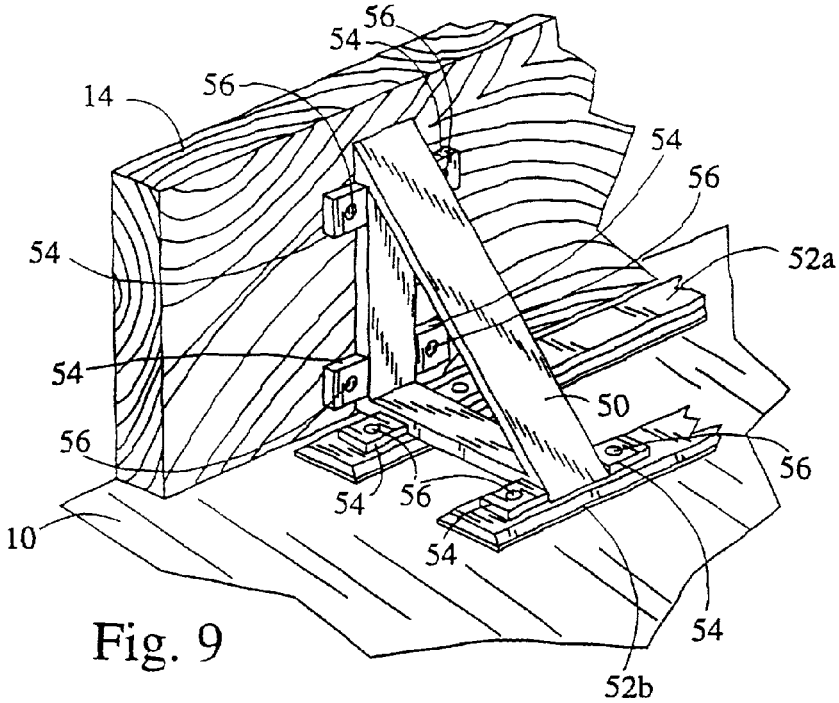
FIG. 9 is an alternative embodiment wherein a brace is affixed indirectly to a slab using strips of material.

FIG. 9 illustrates an alternative embodiment in strips of material 52A, 52B (e.g., wood, metal or plastic) are affixed to the slab 10. Preferably, the strips of material 52A, 52B are affixed to the slab 10 using an adhesive, such as an adhesive tape. However, it will be appreciated that the strips 52A, 52B may be attached to the slab using means other than adhesive, for example nails. In the exemplary embodiment shown in FIG. 9, one strip of material 52A is placed next to the form 14. A second strip 52B is placed a distance away from the form in a parallel direction. One or more braces 50 are then affixed to the strips 52A, 52B and the form 14 as desired. In the illustrated embodiment, the brace 50 is attached to the strips 52A, 52B with nails 56 which are inserted through nail flanges 54. In the illustrated embodiment, two nail flanges 54 (one on each side of the brace) are attached to each of two strips of material 52A, 52B. Nail flanges 54 are also used to attach the back of the vertical side surface of the brace 50 to the form 14. In exemplary embodiments, the brace 50 is molded to include the nail flanges in a one-piece construction. In alternate embodiments, the nail flanges are separate pieces molded to attach (for example, by snapping into place) to a separate brace piece.

Figure 10:
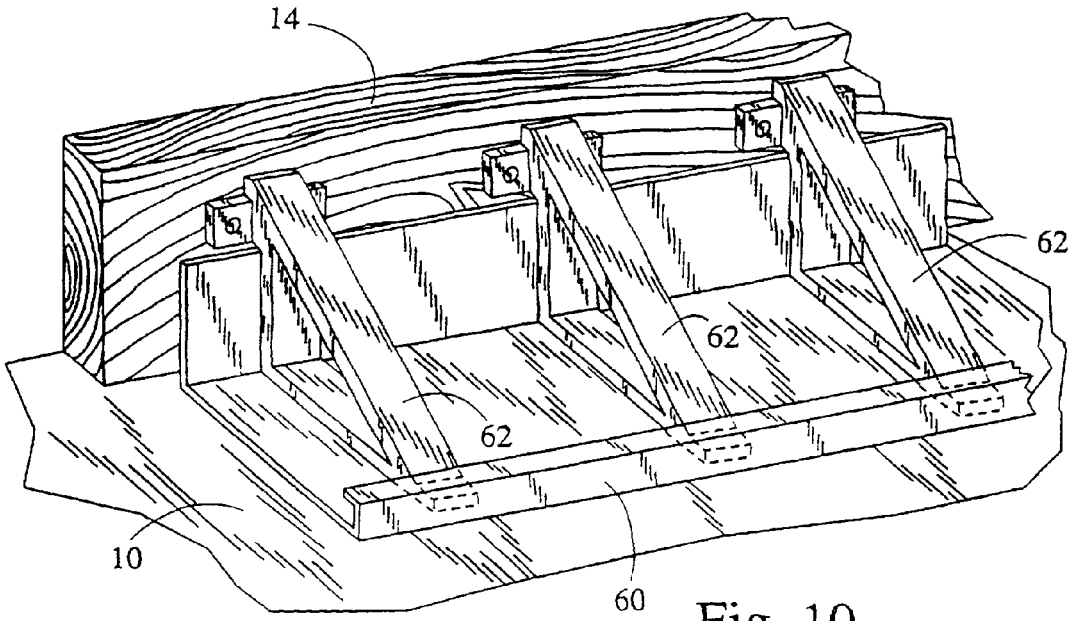
FIG. 10 is an alternative embodiment of an elongated shoe which can be used to hold a plurality of braces.

FIG. 10 illustrates another embodiment of the invention which utilizes an elongated shoe 60. Preferably, the elongated shoe 60 is an extruded piece, for example made of plastic. The back of the elongated shoe is affixed to the form 14, for example, using an adhesive or nails. The bottom of the elongated shoe is affixed to the slab 10, for example, using an adhesive, such as double-sided tape or glue. It will be appreciated that the elongated shoe 60 may be attached to the slab 10 using other means, for example, nails, staples. In exemplary embodiments, an adhesive, such as double-sided tape is pre-applied to the elongated shoe. Multiple braces 62 can be inserted into the elongated shoe 60. In exemplary embodiments, such as the one shown in FIG. 10, the braces 62 are snapped into the elongated shoe 60 (extruded piece) and are affixed to the form 14, for example by nailing or stapling.

Figure 11:
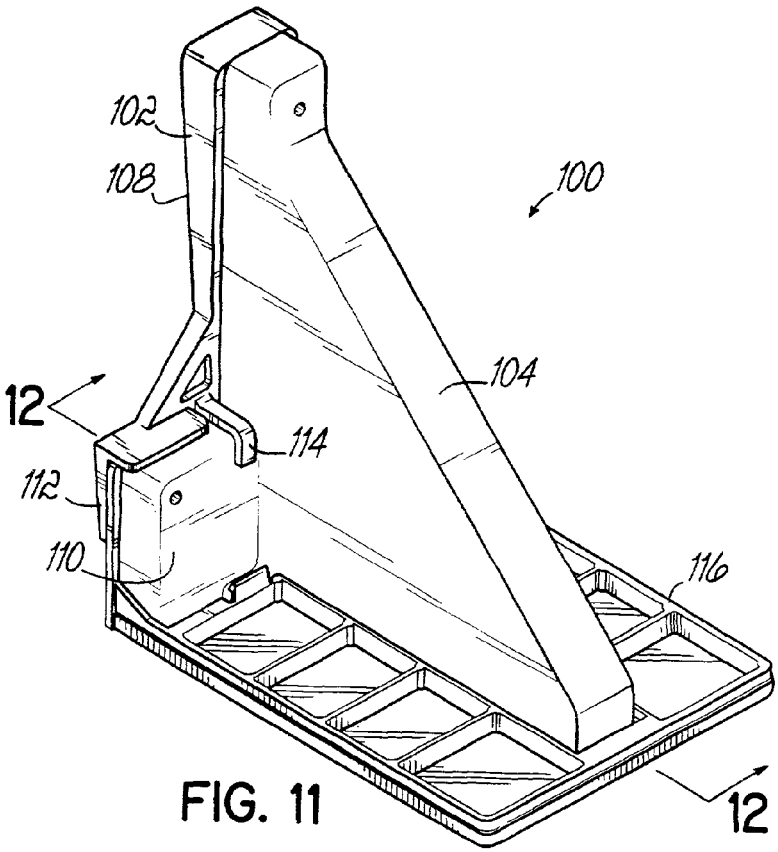
FIG. 11 is a perspective view of a brace for use in tilt-up construction including a brace, flange and shoe formed in accordance with another aspect of the present invention.
Figure 12:
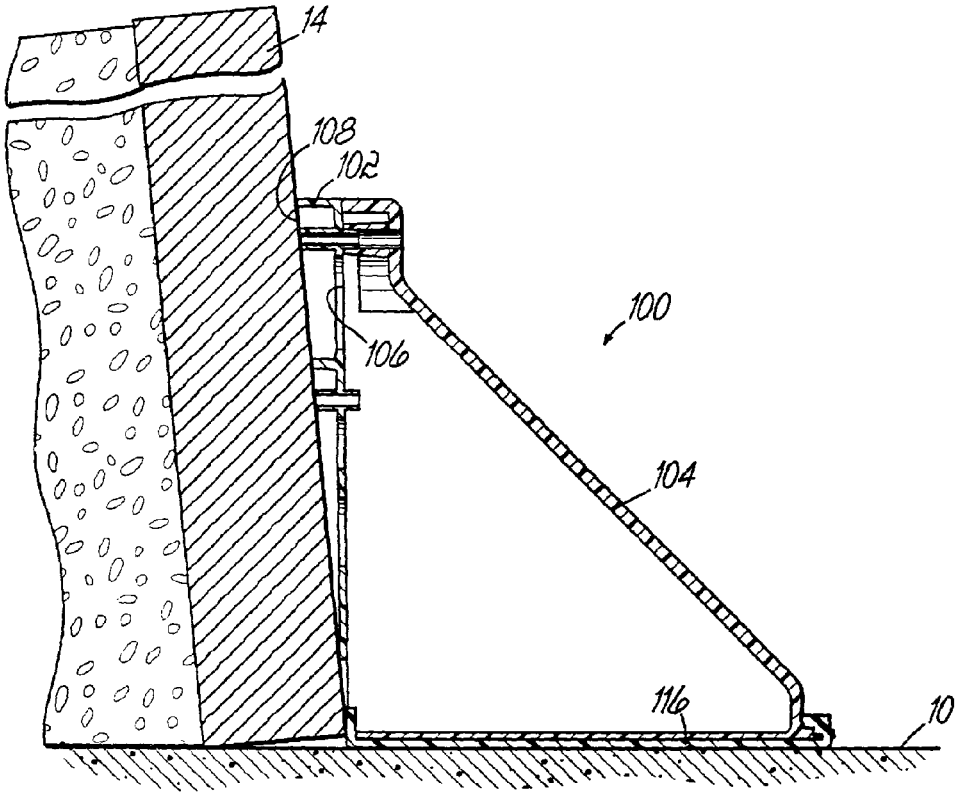
FIG. 12 is a cross-sectional view of the brace of FIG. 11 taken along line 11-11 of FIG. 11, illustrating the brace connected to a conventional form to batter or angle the form.
Figure 13:
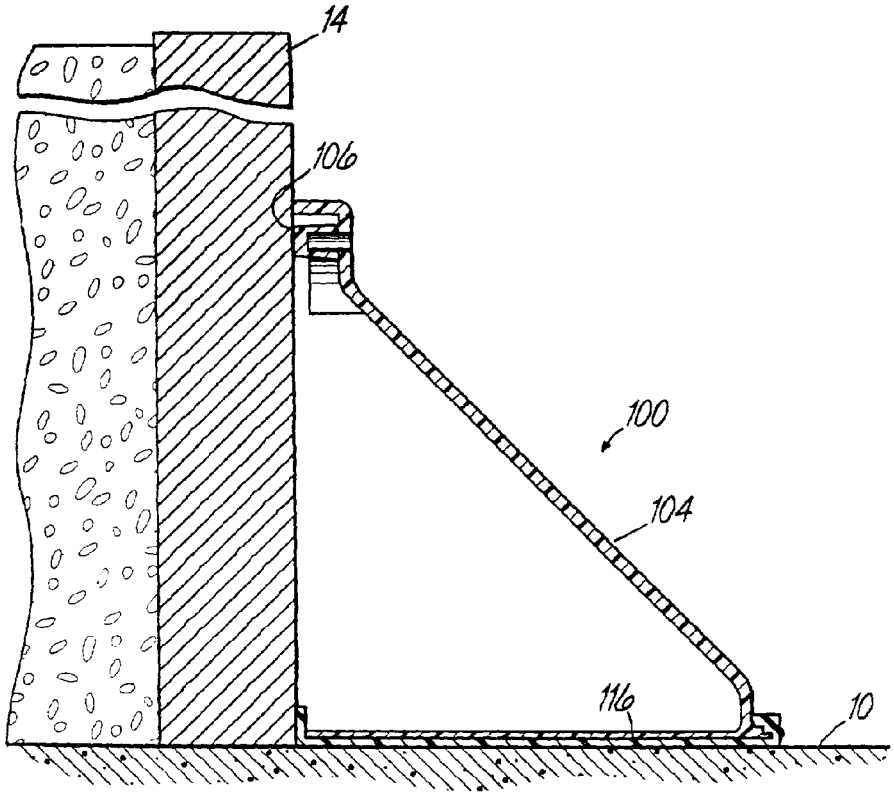
FIG. 13 is a view similar to FIG. 12 illustrating the brace of FIG. 11 connected to a conventional form without the flange.

Referring now to FIGS. 11-13, a brace 100 in accordance with another aspect of the present invention is shown. In this embodiment, a generally T-shaped flange 102 is provided which is releasably securable with a pre-formed brace or bracket 104 to batter or angle the form 14 (FIG. 12) when it is desired. The brace 104 is a pre-formed, molded brace, preferably made of plastic, and has a vertical side surface or form facing surface 106 which can be connected to the form 14 (FIG. 13) using an adhesive or conventional fasteners, such as nails, as described in detail above in connection with brace 30. The flange 102 has a form engaging face 108 which is disposed at a battering angle relative to the vertical side surface 106 of the brace 104 when the flange 102 is placed in contact with the form 14 to batter the form (FIG. 12).

As shown in FIG. 11, the brace 104 has a pair of nail flanges 110 (one on each side of the brace) that may be used to attach the brace 104 to the form 14 using nails. The nail flanges 110 are used to attach the vertical side surface 106 of the brace 104 to the form 14 when the flange 102 is not used. In exemplary embodiments, the brace 104 is molded to include the nail flanges 110 in a one-piece construction. In alternate embodiments, the nail flanges 110 are separate pieces molded to attach (for example, by snapping into place) to a separate brace piece. In one embodiment, as shown in FIG. 11, the flange 102 has spaced tongues 112 and 114 which are positioned on opposite sides of the nail flanges 110 to releasably secure the flange 102 to the brace 104. It is contemplated that flanges 102 of various different battering angles may be provided for different concrete pour form applications. A shoe 116 may be temporarily secured to the slab 10 with adhesive while the brace 104 may be manually inserted and removed from the shoe 116. The shoe 116 and the brace 104 may be molded in a manner which allows the brace to snap or lock into place as described in detail above in connection with brace 30 and shoe 40 of FIGS. 3-8. Preferably, the shoe 116 has holes on the lower surface so that the shoe can be nailed to the slab 10 if desired.

Figure 14:
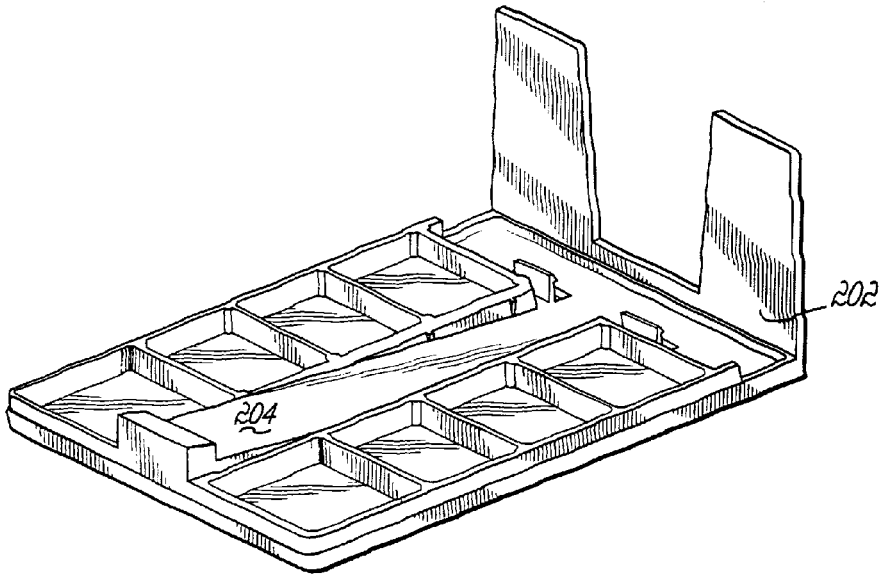
FIG. 14 is a perspective view of a brace shoe formed in accordance with another aspect of the present invention for supporting a brace to batter or angle a form.
Figure 15:
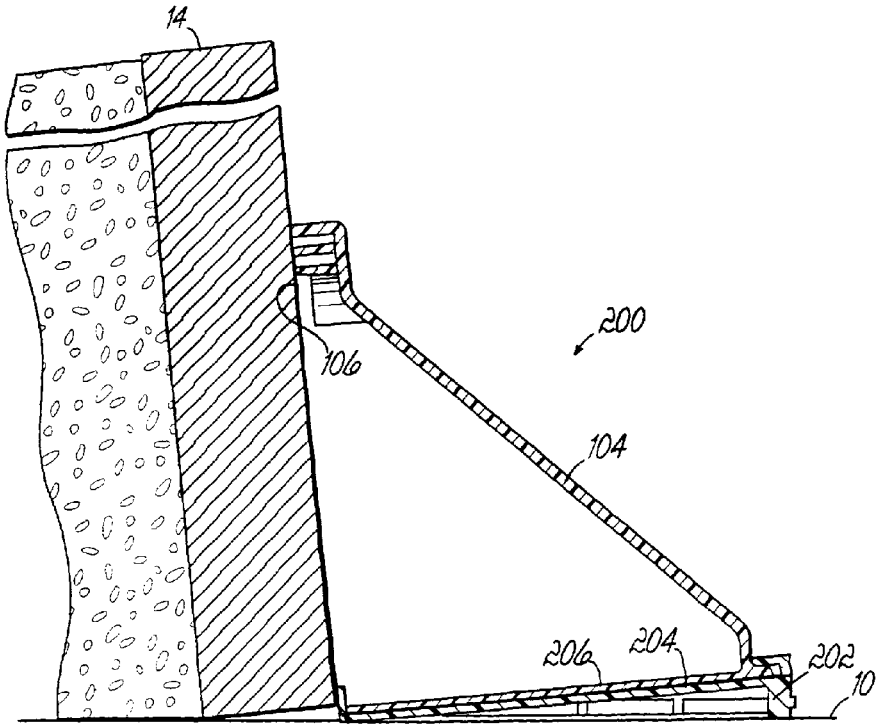
FIG. 15 is a side elevational view of the brace shoe of FIG. 14 supporting a brace, illustrating the brace connected to a convention form to batter or angle the form.

Referring now to FIG. 15, a brace 200 in accordance with yet another aspect of the present invention is shown, where like numerals represent like parts to the brace 100 of FIGS. 11-13. In this embodiment, a shoe 202 may be temporarily secured to the slab 10 with adhesive while the brace 104 may be manually inserted and removed from the shoe 202. The shoe 202 and the brace 104 may be molded in a manner which allows the brace to snap or lock into place as described in detail above. As shown in FIG. 14, the shoe 202 has an upwardly extending inclined ramp 204 that engages a base surface 206 of the brace 104 when the brace is secured in the shoe. The ramp member 204 is operable to orient the brace 104 such that the vertical side surface or form facing surface 106 of the brace is disposed at a battering angle to batter the form 14 when the form facing surface 106 of the brace 104 is placed in contact with the form as shown in FIG. 15. It is contemplated that shoes 202 having ramps of various different inclinations may be provided for orienting the brace 104 at various different battering angles as may be required. Of course, those of ordinary skill in the art will appreciate that shoe 202 may incorporate other mechanical structures for orienting the brace 104 at a battering angle without departing from the spirit and scope of the present invention.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

What is claimed is:

1. A brace kit having component parts capable of being assembled in the field for reinforcing a form member used in the construction of a form atop a support surface, comprising:

a brace shoe having a lower surface adapted to be secured to the support surface and a first locking structure;

a brace member having a second locking structure and configured to directly interlock with said first locking structure of said brace shoe so that said brace member is releasably interlocking with said brace shoe, said brace member having an upwardly extending form facing surface extending generally perpendicular to said lower surface of said brace shoe; and a flange member releasably securable with said brace member and having a form engaging surface disposed at an oblique angle substantially along its entire length relative to the form facing surface of said brace member, wherein an assembled brace acts to angle the form member with respect to the support surface when the form engaging surface of said flange member is placed in contact therewith.

2. The brace of claim 1 further comprising an adhesive material affixed to the lower surface of said brace shoe and adapted to temporarily secure said brace shoe to the support surface.

3. The brace of claim 2 wherein said adhesive material is double-sided adhesive tape.

4. The brace of claim 1 wherein said brace member is manufactured of plastic material.

5. The brace of claim 1 wherein said flange member is manufactured of plastic material.

6. The brace of claim 1 wherein said brace shoe is manufactured of plastic material.

7. The brace of claim 1 further comprising a pair of aligned apertures extending respectively through said brace member and said flange member and adapted to receive a fastener for securing the brace to the form member.

8. A brace kit having component parts capable of being assembled in the field for reinforcing a form member used in the construction of a form atop a support surface, comprising: a brace shoe having an upper surface defining a first locking structure and a lower surface adapted to be secured to the support surface; and a brace member having a base surface defining a second locking structure configured to positively interlock with said first locking structure of said brace shoe in a two-piece lock so that said brace member releasably locks into place in said brace shoe to prevent all substantial relative motion therebetween, said brace member having an upwardly extending form facing surface extending generally perpendicular to said base surface, wherein an assembled brace defines a generally vertically-oriented form facing terminal plane adapted to contact and position the form member with respect to the support surface, wherein said second locking structure comprises a pair of tabs disposed adjacent to said upwardly extending form facing surface and a tongue disposed at a remote end of said brace member.

9. The brace of claim 8, wherein said brace member includes a pair of nail flanges disposed both adjacent to said upwardly extending form facing surface and on opposing sides of said brace member, and for each pair of tabs and nail flanges, one such tab projects from one such nail flange opposite said upwardly extending form facing surface.

10. A brace kit having component parts capable of being assembled in the field for reinforcing a form member used in the construction of a form atop a support surface, comprising: a brace shoe having an upper surface defining a first locking structure and a lower surface adapted to be secured to the support surface; and a brace member having a base surface defining a second locking structure configured to positively interlock with said first locking structure of said brace shoe in a two-piece lock so that said brace member releasably locks into place in said brace shoe to prevent all substantial relative motion therebetween, said brace member having an upwardly extending form facing surface extending generally perpendicular to said base surface, wherein an assembled brace defines a generally vertically-oriented form facing terminal plane adapted to contact and position the form member with respect to the support surface, wherein said two-piece lock is a snap-fit lock.

11. The brace of claim 10, wherein said snap-fit lock includes a resilient latch which positively engages a complementary tab such that said resilient latch must be individually disengaged from said tab in order to releasably separate said brace member from said brace shoe.

12. The brace of claim 11, wherein said snap-fit lock includes a tongue which positively engages a complementary pocket, said tongue being fixed within said pocket by engagment of said resilient latch with said tab.

* * * * *